US006733426B2

(12) United States Patent
Bussell

(10) Patent No.: US 6,733,426 B2
(45) Date of Patent: May 11, 2004

(54) LEG STRETCHING DEVICE

(76) Inventor: Ernie L. Bussell, 11810 W. 138th St., Overland Park, KS (US) 66221

( * ) Notice: Subject to any disclaimer, the term of this patent is extended or adjusted under 35 U.S.C. 154(b) by 0 days.

(21) Appl. No.: 10/096,204

(22) Filed: Mar. 12, 2002

(65) Prior Publication Data

US 2003/0176262 A1 Sep. 18, 2003

(51) Int. Cl.[7] ..... A63B 21/008
(52) U.S. Cl. ..... 482/112; 482/907
(58) Field of Search ..... 482/92, 112, 113, 482/131, 133, 907, 138, 142

(56) References Cited

U.S. PATENT DOCUMENTS 4,647,040 A * 3/1987 Ehrenfried ..... 482/131
4,844,453 A * 7/1989 Hestilow ..... 482/131
5,026,049 A * 6/1991 Goodman ..... 482/131
5,137,504 A * 8/1992 Mangini ..... 482/131
5,277,681 A * 1/1994 Holt ..... 482/112
5,374,230 A * 12/1994 Bonnaime ..... 482/112
5,584,756 A * 12/1996 Grapengiser et al. ..... 482/92
5,616,110 A * 4/1997 Nascimento ..... 482/131
5,904,641 A * 5/1999 Huang ..... 482/131
5,938,573 A * 8/1999 Davies et al. ..... 482/131
6,352,495 B1 * 3/2002 Hsu ..... 482/92

* cited by examiner

*Primary Examiner*—Nicholas D. Lucchesi
*Assistant Examiner*—Fenn Mathew
(74) *Attorney, Agent, or Firm*—Jon Carl Gealow

(57) ABSTRACT

An exercise device for stretching the legs of a user with pressure being applied mainly at the inner thighs, including a seat member and a horizontally disposed rail mounted at one end to the seat member and extends forwardly therefrom and terminates with a free end. Near the free end of the rail a reciprocating sleeve engages the rail for horizontal adjustment thereon. A leg supporting member is mounted pivotally at one end to the seat member on opposing sides of the rail and each such member has a free end. A linking arm is pivotally connected on opposite sides of the rail and at one end to the rail, and each such arm is connected at opposite end to the leg supporting member. A leg deck is mounted at about the side of each leg supporting member to retain the leg of the user in a horizontal position. An engagement member is mounted on each leg supporting member mediate the seat and the leg deck, and adaptable to engage the inside of the thigh of the user. Actuating cylinder is affixed to the sleeve to pivotally actuate the linking arms upon horizontal adjustment of the sleeve so as to impart an arcuate opening and closing movement to the leg supporting members, whereby pressure is applied on the inside of the user's thigh upon leg stretching movement.

10 Claims, 6 Drawing Sheets

LEG STRETCHING DEVICE

FIELD OF THE INVENTION

This invention relates to a leg stretching device. In its more specific aspect, this invention relates to an exercise device for the controlled, intermittent muscle stretching of the legs, in particular the adductor muscles of the thighs.

BACKGROUND OF THE INVENTION AND PRIOR ART

Numerous exercising devices, apparatuses, or machines are known in the art for stretching the muscles of the body, including the limbs of the body. For this type of machine, the general concept of a leg stretching machine is in wide use. These machines for stretching the leg muscles are designed for improving the flexibility of the user in performing the side splits or spread eagle. Most martial arts require extreme flexibility for superior kicking agility. However, flexible and limber limbs are important in many other sports such as gymnastics, ice skating, and track and field events, and further contribute to the overall good health of the user.

In general, these machines or devices comprise a seating arrangement and leg supporting members extending from the seat. When the legs of the user are resting in position on the support members, the legs are forced apart into a spread eagle position by a suitable actuating means. Thus, the object of these machines is to improve the flexibility in performing the side splits of the user. However, most of these devices apply pressure mainly on the ankles. For example, U.S. Pat. No. 5,277,681 discloses a somewhat complex stretching machine for several muscle groups, including the legs as best shown in FIG. 2 of this patent, but the pressure is applied at the ankles. Pressure applied to the ankles is a common feature, as shown in U.S. Pat. No. 5,904,641 which also requires pushing the handle away from the operator; U.S. Pat. No. 4,877,239 which does not use a quick release; U.S. Pat. No. 4,781,373, which also requires a manual pull; and U.S. Pat. 5,584,756. In U.S. Pat. 4,456,247, the handle is moved toward the operator to actuate the cables to move the leg supports, but again the pressure is mainly at the ankles. A pushing effect is disclosed in U.S. Pat. No. 5,026,049, which also uses a worm gear and has no quick release. A vertical lifting is shown in U.S. Pat. Nos. 5,374,230 and 5,507,711. In U.S. Pat. No. 4,844,453, the jack is disposed under the seat, and the device applies pressure to the leg supporting member on the opposite side of the pivot point.

The exercising machines disclosed and known in the prior art require a pulling action in contrast to a pushing action, or apply pressure at the ankles, or appear to be unduly complicated and expensive. Thus, this invention has as its purpose to provide a leg stretching device that is relatively simple in structure and in operation, and is safe for the user.

It is another object of the invention to provide for a leg stretching device that applies pressure mainly at the thighs of the user, thereby improving or increasing the flexibility of the user in his/her ability in performing the side splits.

SUMMARY OF THE INVENTION

In its broad aspect, the invention comprises an exercise device for stretching the legs of a user with pressure being applied mainly at the thighs. The device or apparatus includes a seat member, preferably a back rest which is adjustable for the comfort of the user, and a horizontally disposed rail mounted at one end to the seat member and extends forwardly therefrom and terminates with a free end. Near the free end of the rail, that is near the end opposed to the end on which the seat is mounted, a reciprocating sleeve engages the rail for horizontal movement thereon. A leg supporting member is mounted pivotally at one end to the seat member on opposing sides of the rail, and each such leg supporting member has a free end. Each leg supporting member includes means for adjusting the length to accommodate users of different height or size. A linking arm is pivotally connected on opposite sides of the reciprocating sleeve near the free end of the rail, and each such arm is connected at the opposite end to the leg supporting member. A leg deck is mounted at about the free end on each leg supporting member, and each leg deck includes a horizontal platform and a riser to retain the leg of the user in a horizontal position. An engagement member is mounted on each leg supporting member mediate the seat and the leg deck, and the engaging member is adaptable to engage the inside of the thigh of the user. Actuating means is affixed to the reciprocating sleeve to pivotally actuate the liking arms upon horizontal movement of the sleeve so as to impart an arcuate opening and closing movement to the leg supporting members, whereby pressure is applied on the inside of the user's thigh upon a leg stretching movement.

In a preferred embodiment of my invention, the actuation means comprises a hydraulic cylinder, which is actuated by the user. Thus, pressurized hydraulic fluid supplied to either side of the piston effects reciprocal movement of the piston and thereby moves the sleeve horizontally. This movement in turns actuates the lining arms.

BRIEF DESCRIPTION OF THE DRAWINGS

The invention and its advantages will be more readily understood by reference to the following detailed description and exemplary embodiment when read in conjunction with the following drawings, wherein.

DETAILED DESCRIPTION OF THE INVENTION AND PREFERRED EMBODIMENT

Figure 1:
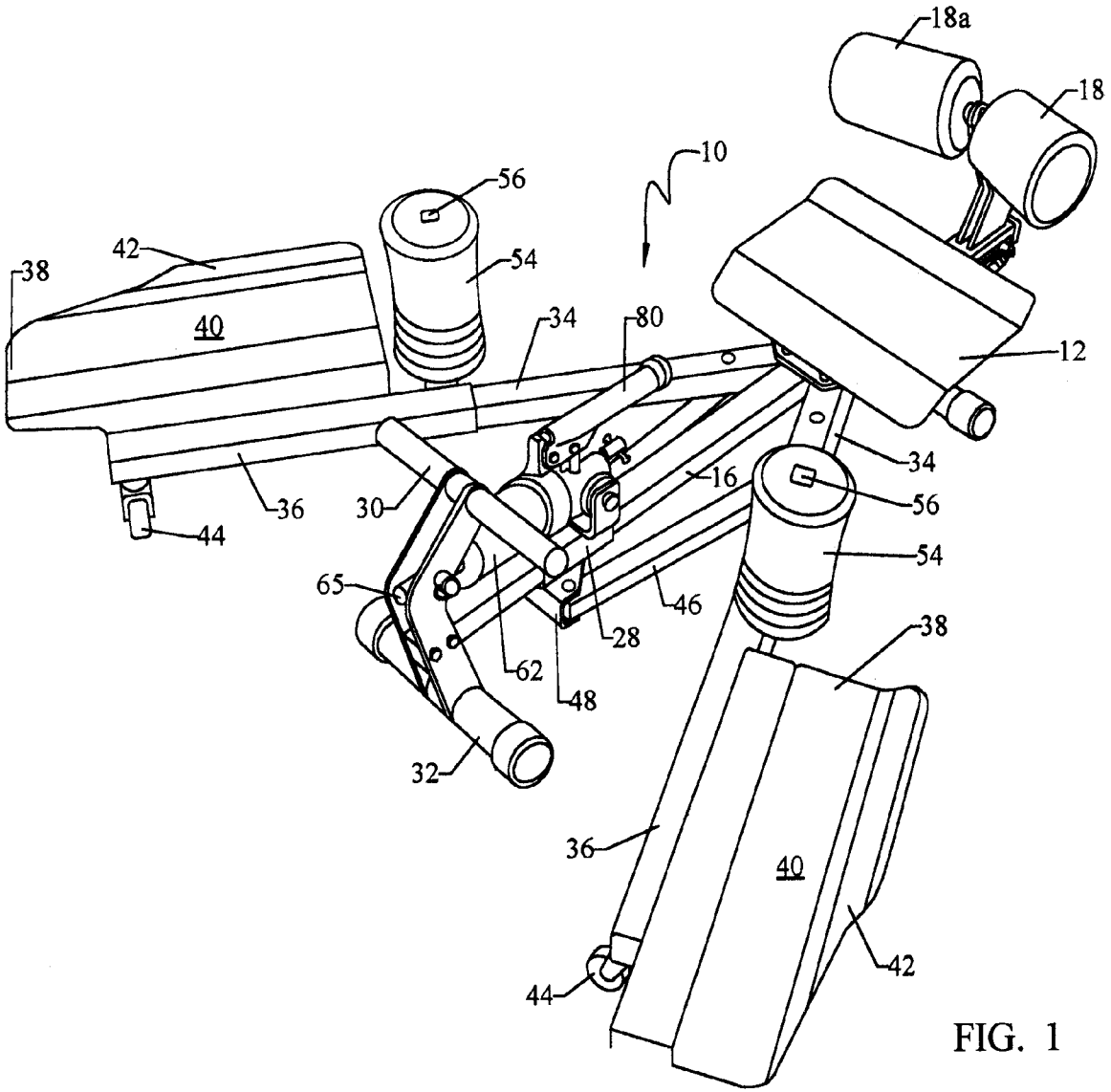
FIG. 1 is a perspective view of the leg stretching device embodying my invention showing the leg supporting members in a partially opened position.
Figure 2:
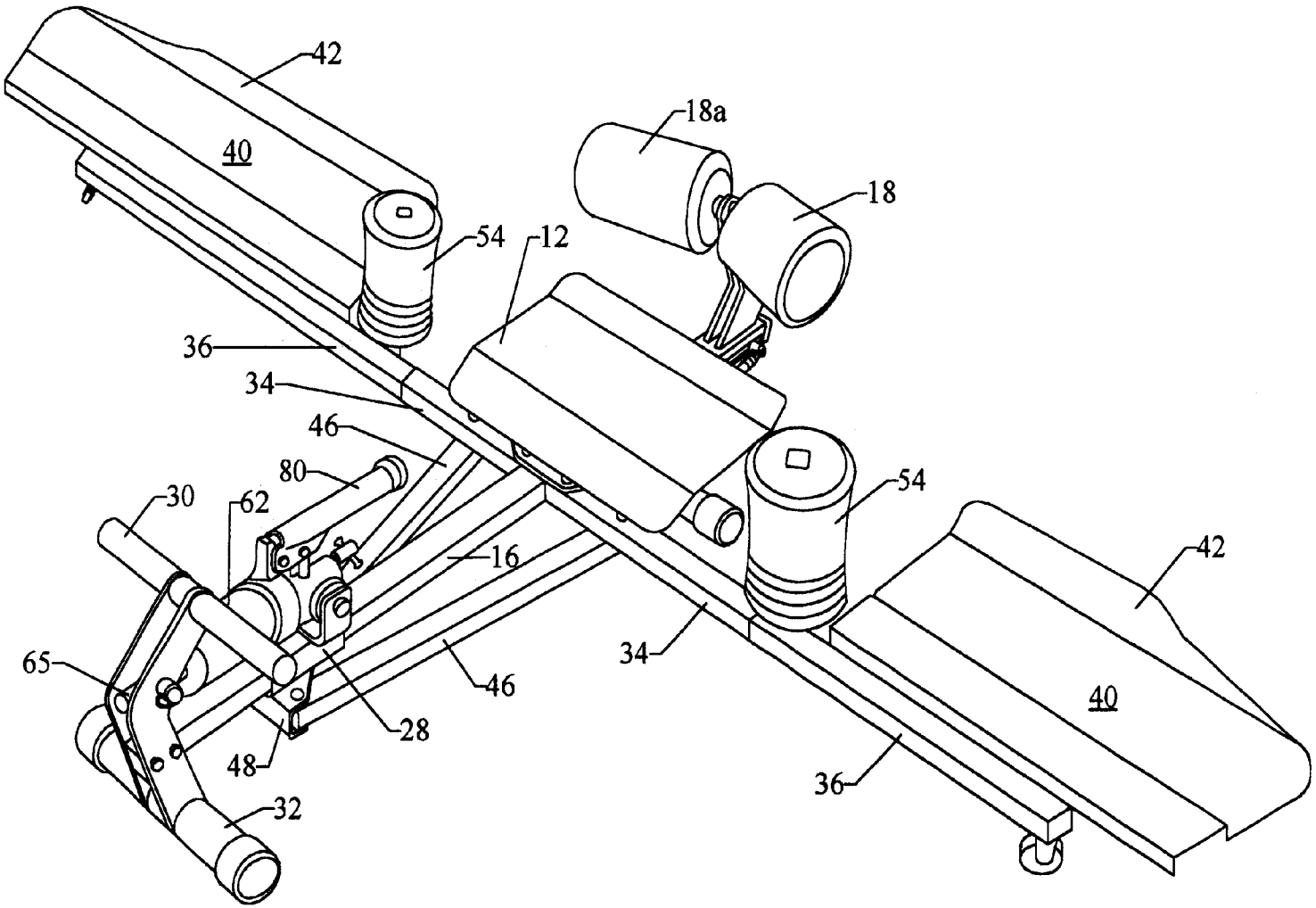
FIG. 2 is a perspective view of the leg stretching device of FIG. 1 showing the leg supporting members in a full opened position.
Figure 3:
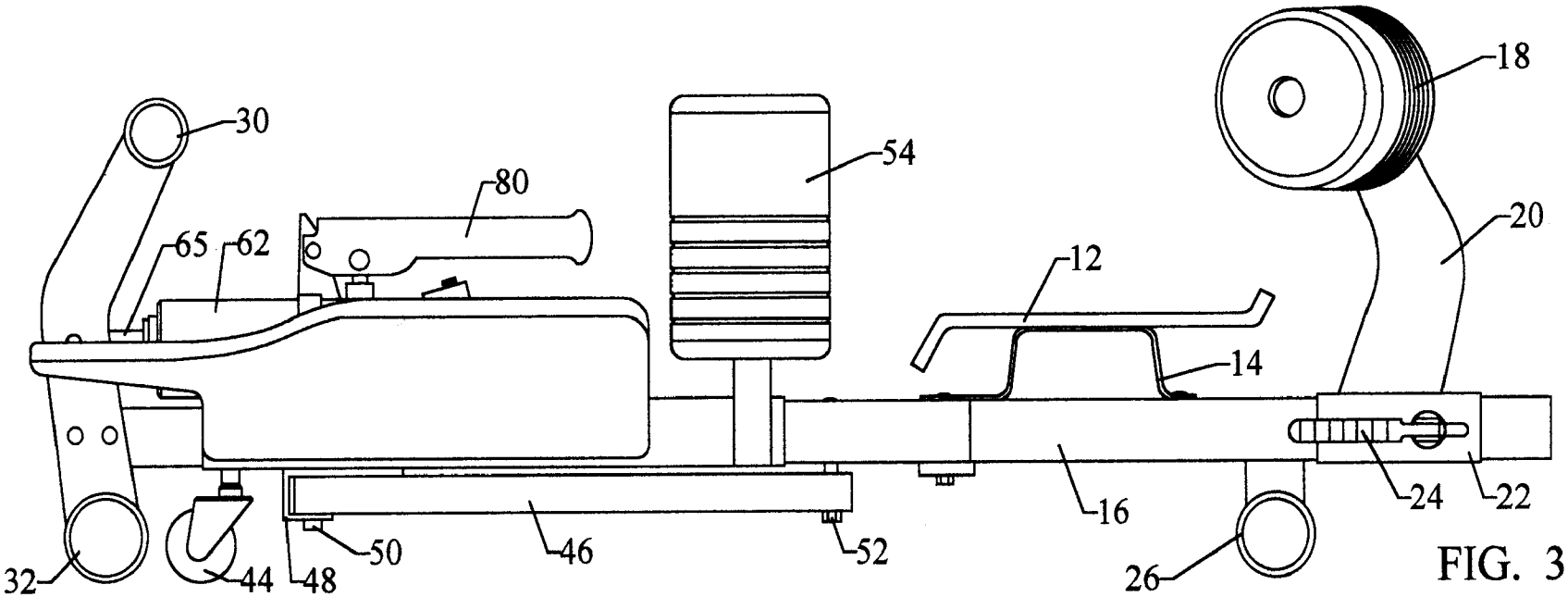
FIG. 3 is a side elevational view of the leg stretching device of FIG. 1 in an essentially closed position.
Figure 4:
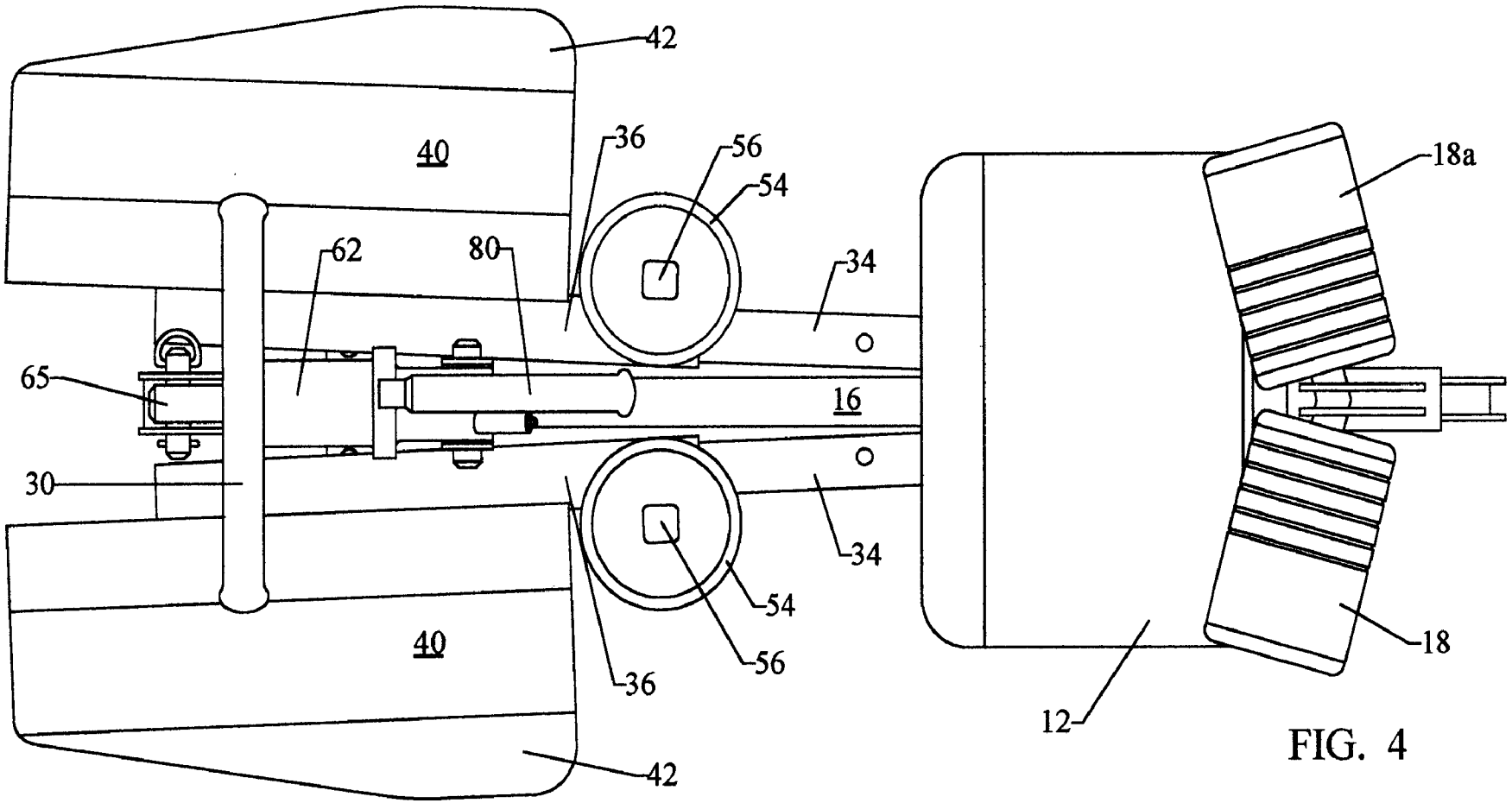
FIG. 4 is a plan view of the device of FIG. 3.
Figure 5:
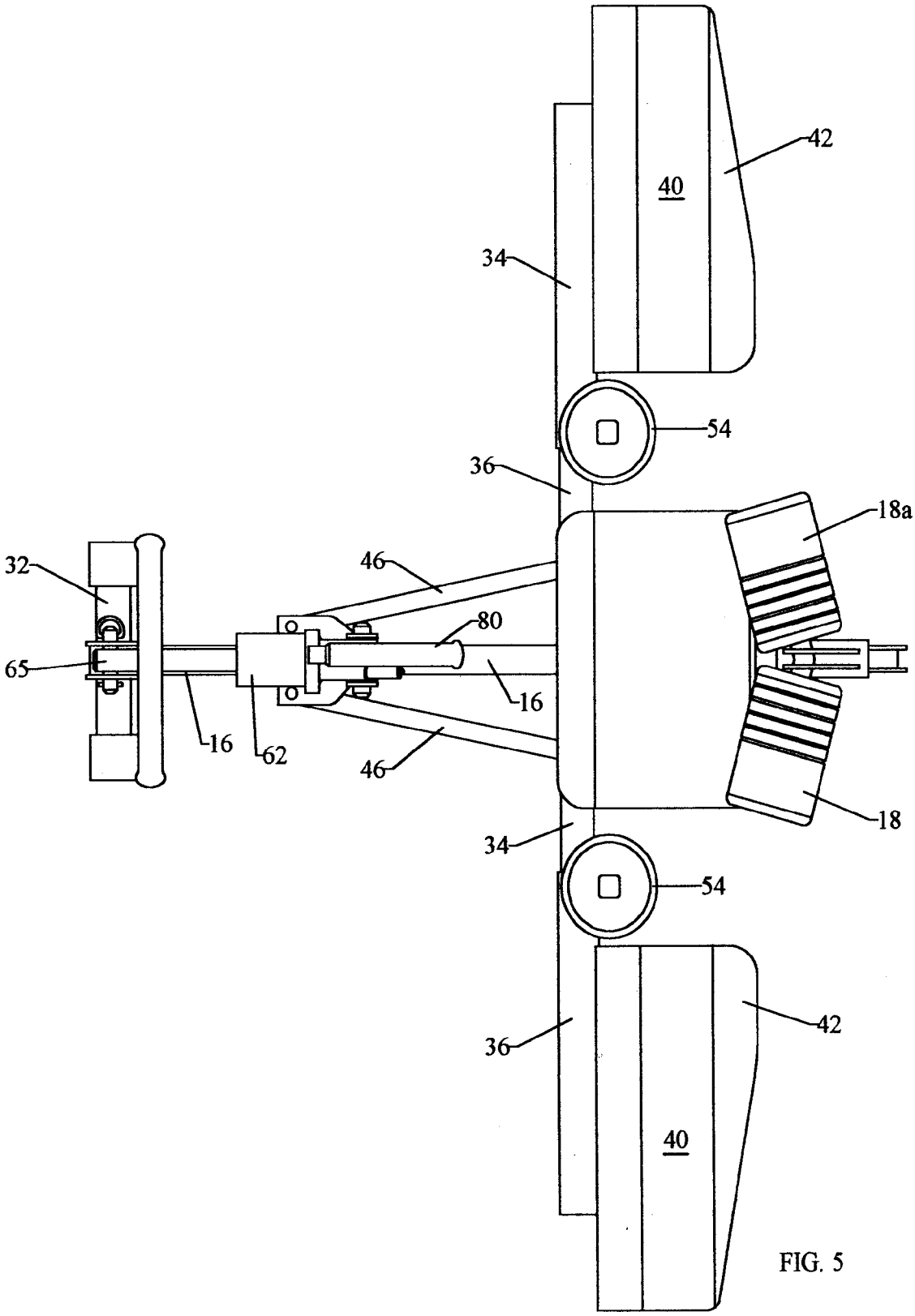
FIG. 5 is a plan view of the device of FIG. 3 but in an open position as shown in FIG. 2.

Referring to the drawings, wherein the same reference numerals refer to similar parts throughout the several views, there is shown in FIG. 1 the leg stretching device or machine of my invention indicated generally by the numeral 10. A seat member 12 supported by a bracket 14 is connected to an outwardly extending, horizontal center rail 16 preferably of rectangular configuration as viewed in transverse cross-section on the longitudinal axis. The seat preferably includes a suitable back rest 18 and 18*a,* such as cylindrical bodies for comfort as illustrated, and desirably formed of a resilient material such as a closed-cell foam or rubber or neoprene.

The rollers are supported by a brace 20 attached to a sleeve 22 mounted on the rail behind the seat, and a quick release latch 24 allows for adjusting the position of the back rest. The rail and seat are supported at about opposed ends by suitable legs 26.

A sleeve 28 is slidably mounted near the free end of the rail 16 (that is, opposite to the seat) for reciprocal horizontal movement along the longitudinal axis of the rail, so that actuation effects horizontal adjustment or slidable movement of the sleeve along the rail, as explained below in detail. A handle 30, having a footing 32, is affixed at the free end of the rail 16, and the handle may be gripped by the user during an exercise movement.

On opposed sides of the rail 16 there is provided leg supporting members 34 pivotally mounted at one end to the underside of the seat member 12. The leg supporting members include tubular extensions 36 for telescopic engagement therewith. In this manner, the over-all length of the leg supporting members can be adjusted to accommodate the height of the user. That is, a taller person using the exercise device can easily adjust the length of the leg supporting members by moving the extensions in or out in order to fit his/her height. Further, leg deck 38, having a horizontal platform 40 and vertical riser 42, is mounted on each extension 36 of leg supporting member 34 and near the free end thereof. Thus, when the user is seated in an exercising position, each leg is supported by the leg deck 38 and is thereby retained in a horizontal position. Suitable caster wheels 44 are mounted on the underside of the leg supporting members to facilitate arcuate movement of these members, as explained below.

Linking arms 46 connects each leg supporting member 34 to he opposite sides of the rail 16. Thus, a U-bracket 48 is affixed to the sleeve 28, and one end of each linking arm 46 is inserted into the open end of the bracket and pivotally connected to the bracket by pin 50. The opposite ends of the linking arms are pivotally connected to the leg supporting members by pins 52. In this manner, pivotal actuation of the linking arms 46 imparts arcuate movement to the leg supporting members 34, as explained below.

There is mounted on each leg supporting member 34 an engagement member 54 mediate the seat member 12 and the leg deck 38. Thus, it will be observed that when the user is in an exercising position with the legs resting on the leg deck 38 of the leg supporting members 34, the thighs of the user are engaged by members 54, which desirabley are mounted on spindles 56 so as to be free to rotate. Preferably, the engagement members are formed of a resilient material, such as a closed-cell foam or neoprene.

Figure 6:
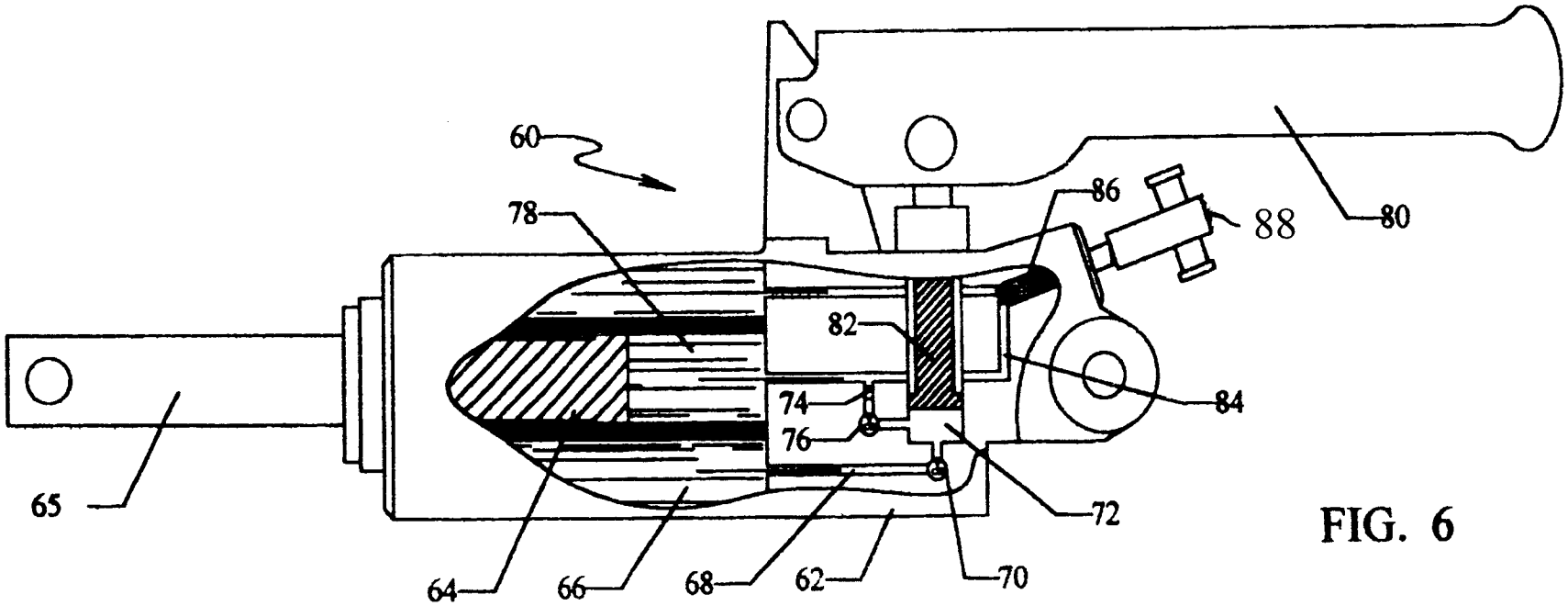
FIG. 6 is a side elevational view of an actuating means useful for my invention, partially broken away to show in cross-section the details of the actuating means.

Referring now to FIG. 6, there is shown a cylinder-piston assembly, indicated generally by the numeral 60, which depicts a suitable hydraulic actuating means of the type well known in the art. The cylinder-piston assembly comprises a cylinder housing 62 mounted on sleeve 28, and piston 64 having a piston rod 65 extending outwardly from the housing and is affixed at the free end to rail 16. Cylinder housing 62 is provided with a fluid reservoir 66, and a first fluid passageway 68 opens to the reservoir 66 past check valve 70 to provide fluid communication with first chamber 72. A second fluid passageway 74 establishes fluid communication from the first chamber 72 through check valve 76 to second chamber 78, thereby completing the fluid communication means extending from the reservoir 66 to the second chamber 78 in which the cylinder and piston reciprocate relative to each other. Thus, upon a upward stroke on handle 80, check valve 70 opens and check valve 76 is closed, fluid is drawn from the reservoir 66 into first chamber 72applying pressure against reciprocal member 82. Conversely, upon an downward stroke of the handle 80, check valve 70 is closed and prevents fluid from returning to the reservoir, but check valve 76 is opened and fluid flows from the first chamber 72 to the second chamber 78. As the hydraulic fluid is pumped in this manner to the second chamber, the cylinder is reciprocated to the right as viewed in the drawing because the piston is affixed to the rail. As a consequence, the sleeve 28 is moved along the rail 16, thereby actuating the linking arms 46 which moves the leg supporting member 34 outwardly from the rail to impart a stretching action to the user's legs. A return line 84 establishes fluid communication between the second chamber 78 and the reservoir 66, 50 that when the user has reached his limit of stretching, the release needle valve 86 is opened by turning the handle 88, fluid then returns to the reservoir and the linking arms are retracted.

When a person chooses to use the leg stretching apparatus, the user will first adjust the seat back rest 18, 18*a* and the leg extensions 36 to fit his/her size and height. The user assumes a sitting position with the legs supported on the leg decks 38. The user then actuates the hydraulic jack 60 by pumping the handle 80, as explained above. Hydraulic fluid exerts a pressure on the piston 64, and because the piston rod is attached to the rail 16, and the cylinder housing 62 is affixed to the reciprocal sleeve 28, the cylinder moves horizontally thereby effecting reciprocal movement of the sleeve. This movement in turn actuates the linking arms 46, which impart an arcuate movement to the leg supporting members. It will be observed that actuation of the jack is controlled solely by the user, who thereby can control the stretching of the legs and in particular the adductor muscles. Moreover, the device provides for a quick release, which is especially desirable if the stretching reaches or exceeds one's limit. Hence, the device of my invention is safe and easy to use.

By reason of the invention, numerous advantages are achieved. In addition, it should be understood that the foregoing detailed description has been given for clearness of understanding only, and no unnecessary limitations should be understood therefrom, as modifications will be obvious to those skilled in the art.

What is claimed is:

1. An exercise device for stretching the thighs of a user, comprising:

a) a seat member;

b) a horizontally disposed rail mounted at one end to said seat member and extending forwardly therefrom and terminating with a free end;

c) a sleeve engaging said rail at about said free end of said rail for longitudinal adjustment thereon;

d) a pair of leg supporting members each mounted pivotally at one end to said seat member on opposing sides of said rail and having a free end extending forwardly from said seat member;

e) a pair of linking arms each pivotally connected at one end to said sleeve and connected at the other end to one of said pair of leg supporting members between said pivotally mounted end and said free end;

f) a pair of leg decks each mounted at about the side of said leg supporting members, said leg deck including a horizontal platform and a riser to retain the leg of the user in a horizontal position;

g) a pair of engagement members each mounted vertically perpendicular on said leg supporting members mediate said seat member and said leg deck for engaging the inside of the thigh of the user; and h) actuating means affixed to said sleeve to pivotally actuate said linking arms upon horizontal adjustment of said sleeve so as to impart arcuate opening and closing movement to said leg supporting members; said pair of engagement members applying pressure on the inside of the user's thigh upon leg stretching movement.

2. An exercise device according to claim 1 wherein each of said engagement members comprises a substantially cylindrical body of closed-cell foam rubber rotatably mounted with the longitudinal axis disposed substantially normal to said leg supporting members.

3. An exercise device according to claim 1 including tubular extensions telescopically engaging said leg supporting members for adjusting the length of said leg supporting members.

4. An exercise device for stretching the thighs of a user, comprising:

a) a seat member;

b) a horizontally disposed rail mounted at one end to said seat member and extending forwardly therefrom and terminating with a free end;

c) a sleeve engaging said rail at about said free end of said rail for longitudinal adjustment thereon;

d) a pair of leg supporting members each mounted pivotally at one end to said seat member on opposing sides of said rail and having a free end extending forwardly from said seat member;

e) a pair of linking arms each pivotally connected at one end to said sleeve and connected at the other end to one of said pair of leg supporting members between said pivotally mounted end and said free end;

f) a pair of leg decks each mounted at about the side of said leg supporting members, said leg deck including a horizontal platform and a riser to retain the leg of the user in a horizontal position;

g) a pair of engagement members each mounted on said leg supporting members mediate said seat member and said leg deck adaptable to engage the inside of the thigh of the user; and h) actuating means affixed to said sleeve to pivotally actuate said linking arms upon horizontal adjustment of said sleeve so as to impart arcuate opening and closing movement to said leg supporting members; said actuating means comprises a hydraulic cylinder having a reciprocating piston affixed at about the free end of said rail and a cylinder mounted on said sleeve to effect horizontal movement of said sleeve upon the reciprocal movement of said piston, said hydraulic cylinder includes a first handle extending from said cylinder towards said seat member for actuating said cylinder by said user, a second handle for a release valve extending from said cylinder towards said seat member, such that when said release valve is opened, closing movement may be imparted to said leg supporting members, a third handle is provided at the free end of the rail for gripping by a user during exercise movement, with said first and second handles being located between said third handle and said seat member, whereby pressure is applied on the inside of the user's thigh upon leg stretching movement.

5. An exercise device for stretching the thighs of a user, comprising:

a) a seat member;

b) a horizontally disposed rail mounted at one end to said seat member and extending forwardly therefrom and terminating with a free end;

c) a sleeve engaging said rail at about said free end of said rail for longitudinal adjustment thereon;

d) a pair of leg supporting members each mounted pivotally at one end to said seat member on opposing sides of said rail and having a free end extending forwardly from said seat member;

e) a pair of linking arms each pivotally connected at one end to said sleeve and connected at the other end to one of said pair of leg supporting members between said pivotally mounted end and said free end;

f) a pair of leg decks each mounted at about the side of said leg supporting members, said leg deck including a horizontal platform and a riser to retain the leg of the user in a horizontal position;

g) a pair of engagement members each mounted on said leg supporting members mediate said seat member and said leg deck adaptable to engage the inside of the thigh of the user; and h) actuating means affixed to said sleeve to pivotally actuate said linking arms upon horizontal adjustment of said sleeve so as to impart arcuate opening and closing movement to said leg supporting members, said actuating means comprises a hydraulic cylinder having a reciprocating piston affixed at about the free end of said rail and a cylinder mounted on said sleeve to effect horizontal movement of said sleeve upon the reciprocal movement of said piston; whereby pressure is applied on the inside of the user's thigh upon leg stretching movement.

6. An exercise device for stretching the thighs of a user, comprising:

a) a seat member;

b) a horizontally disposed rail mounted at one end to said seat member and extending forwardly therefrom and terminating with a free end;

c) a sleeve engaging said rail at about said free end of said rail for longitudinal adjustment thereon;

d) a pair of leg supporting members each mounted pivotally at one end to said seat member on opposing sides of said rail and having a free end extending forwardly from said seat member;

e) a pair of linking arms each pivotally connected at one end to said sleeve and connected at the other end to one of said pair of leg supporting members between said pivotally mounted end and said free end;

f) a pair of leg decks each mounted at about the side of said leg supporting members, said leg deck including a horizontal platform and a riser to retain the leg of the user in a horizontal position;

g) a pair of engagement members each mounted on said leg supporting members mediate said seat member and said leg deck adaptable to engage the inside of the thigh of the user, each of said engagement members comprises a substantially cylindrical body of closed-cell foam rubber rotatably mounted with the longitudinal axis disposed substantially normal to said leg supporting members, and h) actuating means affixed to said sleeve to pivotally actuate said linking arms upon horizontal adjustment of said sleeve so as to impart arcuate opening and closing movement to said leg supporting members, said actuating means comprises a hydraulic cylinder having a reciprocating piston affixed at about the free end of said rail and a cylinder mounted on said sleeve to effect horizontal movement of said sleeve upon the reciprocal movement of said piston, whereby pressure is applied on the inside of the user's thigh upon leg stretching movement.

7. An exercise device for stretching the thighs of a user, comprising:

a) a seat member;

b) a horizontally disposed rail mounted at one end to said seat member and extending forwardly therefrom and terminating with a free end;

c) a sleeve engaging said rail at about said free end of said rail for longitudinal adjustment thereon;

d) a pair of leg supporting members each mounted pivotally at one end to said seat member on opposing sides of said rail and having a free end extending forwardly from said seat member; tubular extensions telescopically engaging said leg supporting members for adjusting the length of said leg supporting members, e) a pair of linking arms each pivotally connected at one end to said sleeve and connected at the other end to one of said pair of leg supporting members between said pivotally mounted end and said free end;

f) a pair of leg decks each mounted at about the side of said leg supporting members, said leg deck including a horizontal platform and a riser to retain the leg of the user in a horizontal position;

g) a pair of engagement members each mounted on said leg supporting members mediate said seat member and said leg deck adaptable to engage the inside of the thigh of the user; and h) actuating means affixed to said sleeve to pivotally actuate said linking arms upon horizontal adjustment of said sleeve so as to impart arcuate opening and closing movement to said leg supporting members, said actuating means comprises a hydraulic cylinder having a reciprocating piston affixed at about the free end of said rail and a cylinder mounted on said sleeve to effect horizontal movement of said sleeve upon the reciprocal movement of said piston; whereby pressure is applied on the inside of the user's thigh upon leg stretching movement.

8. An exercise device according to claim 5, 6, or 7 wherein said hydraulic cylinder includes a handle for actuating said cylinder by said user.

9. An exercise device according to claim 8, wherein said handle for actuating said cylinder extends from said cylinder towards said seat member.

10. An exercise device according to claim 5, 6, or 7, wherein a handle for a release valve extends from said cylinder towards said seat member, such that when said release valve is opened, closing movement may be imparted to said leg supporting members.

* * * * *